US008203491B2

(12) United States Patent
Yang et al.

(10) Patent No.: US 8,203,491 B2
(45) Date of Patent: Jun. 19, 2012

(54) HOUSING, WIRELESS COMMUNICATION DEVICE USING THE HOUSING, AND MANUFACTURING METHOD THEREOF

(75) Inventors: Fu-Keng Yang, Taipei Hsien (TW); Bing Zhang, Shenzhen (CN); Yi-Ping Zeng, Shenzhen (CN); Jian-Jun Zhan, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 580 days.

(21) Appl. No.: 12/354,081

(22) Filed: Jan. 15, 2009

(65) Prior Publication Data

US 2009/0189818 A1 Jul. 30, 2009

(30) Foreign Application Priority Data

Jan. 30, 2008 (CN) ..... 2008 1 0300274

(51) Int. Cl.
*H01Q 1/24* (2006.01)

(52) U.S. Cl. ..... 343/702; 343/700 MS

(58) Field of Classification Search ..... 343/700 MS, 343/702, 841, 846, 872, 906
See application file for complete search history.

(56) References Cited

U.S. PATENT DOCUMENTS

| | | | | |
|---|---|---|---|---|
| 6,396,444 | B1 * | 5/2002 | Goward et al. | 343/702 |
| 6,764,626 | B2 * | 7/2004 | Phu et al. | 264/129 |
| 6,937,196 | B2 * | 8/2005 | Korva | 343/702 |
| 6,940,459 | B2 * | 9/2005 | Sullivan et al. | 343/702 |
| 7,847,753 | B2 * | 12/2010 | Ishibashi et al. | 343/897 |
| 2002/0109641 | A1 * | 8/2002 | Goward et al. | 343/873 |
| 2007/0216580 | A1 | 9/2007 | Lin et al. | |

FOREIGN PATENT DOCUMENTS

| | | | |
|---|---|---|---|
| CN | 1336020 | A | 2/2002 |
| DE | 202006019045 | U1 | 3/2007 |
| EP | 1855514 | A1 | 11/2007 |
| EP | 1868263 | A1 | 12/2007 |
| GB | 2345196 | A | 6/2000 |
| WO | 2007/094494 | A1 | 8/2007 |
| WO | 2007/101902 | A1 | 9/2007 |

* cited by examiner

*Primary Examiner* — Tan Ho
(74) *Attorney, Agent, or Firm* — Altis Law Group, Inc.

(57) ABSTRACT

A housing for a wireless communication device includes a decorative film having an antenna pattern formed thereon, a protective coating covering the antenna pattern, and a substrate moldingly attached to the decorative film and the protective coating. The antenna pattern is a conductive ink coating. The antenna pattern and the protective coating are sandwiched between the decorative film and the substrate.

6 Claims, 2 Drawing Sheets

HOUSING, WIRELESS COMMUNICATION DEVICE USING THE HOUSING, AND MANUFACTURING METHOD THEREOF

CROSS-REFERENCE TO RELATED APPLICATIONS

This application is one of the six related co-pending U.S. patent applications listed below. All listed applications have the same assignee and were concurrently filed herewith. The disclosure of each of the listed applications is incorporated by reference into all the other listed applications.

| Attorney Docket No. | Title | Inventors |
|---|---|---|
| US18930 | HOUSING, WIRELESS COMMUNICATION DEVICE USING THE HOUSING, AND MANUFACTURING METHOD THEREOF | Fu-Keng Yang et al. |
| US18931 | HOUSING, WIRELESS COMMUNICATION DEVICE USING THE HOUSING, AND MANUFACTURING METHOD THEREOF | Fu-Keng Yang et al. |
| US18932 | HOUSING, WIRELESS COMMUNICATION DEVICE USING THE HOUSING, AND MANUFACTURING METHOD THEREOF | Fu-Keng Yang et al. |
| US18933 | HOUSING, WIRELESS COMMUNICATION DEVICE USING THE HOUSING, AND MANUFACTURING METHOD THEREOF | Fu-Keng Yang et al. |
| US19305 | HOUSING, WIRELESS COMMUNICATION DEVICE USING THE HOUSING, AND MANUFACTURING METHOD THEREOF | Fu-Keng Yang et al. |
| US19306 | HOUSING, WIRELESS COMMUNICATION DEVICE USING THE HOUSING, AND MANUFACTURING METHOD THEREOF | Fu-Keng Yang et al. |

BACKGROUND

1. Field of the Disclosure

The present disclosure relates to wireless communication devices, and particularly to a device housing having a conductive track for sending and receiving electromagnetic waves.

2. Description of Related Art

Antennas sending or receiving electromagnetic waves are basic units used in mobile communication devices. With increasing demand for reduced device profile, antennas are frequently incorporated into housings of such devices.

The antennas incorporated in the housings are usually copper or silver sheets formed in a patterned conductive track. A frequent method of manufacturing such housings includes attaching a patterned copper or silver sheet to a laminate using adhesive, in which the laminate may be a plastic film used in an insert molding process. The laminate is mounted into an injection mold, and a melted resin is injected into the injection mold and molded thereon to form a molded housing. The resulting patterned copper or silver sheet can function as an antenna when the molded housing is used in a mobile communication device. However, the patterned copper or silver sheet typically has a thickness exceeding 0.3 millimeters (mm), increasing the thickness and size of the molded housing.

Therefore, there is room for improvement within the art.

BRIEF DESCRIPTION OF THE DRAWINGS

Many aspects of the housing for a wireless communication device can be better understood with reference to the following drawings. The components in the drawings are not necessarily drawn to scale, the emphasis instead being placed upon clearly illustrating the principles of the molded article. Moreover, in the drawings like reference numerals designate corresponding parts throughout the several views.

DETAILED DESCRIPTION OF THE DISCLOSURE

Figure 1:
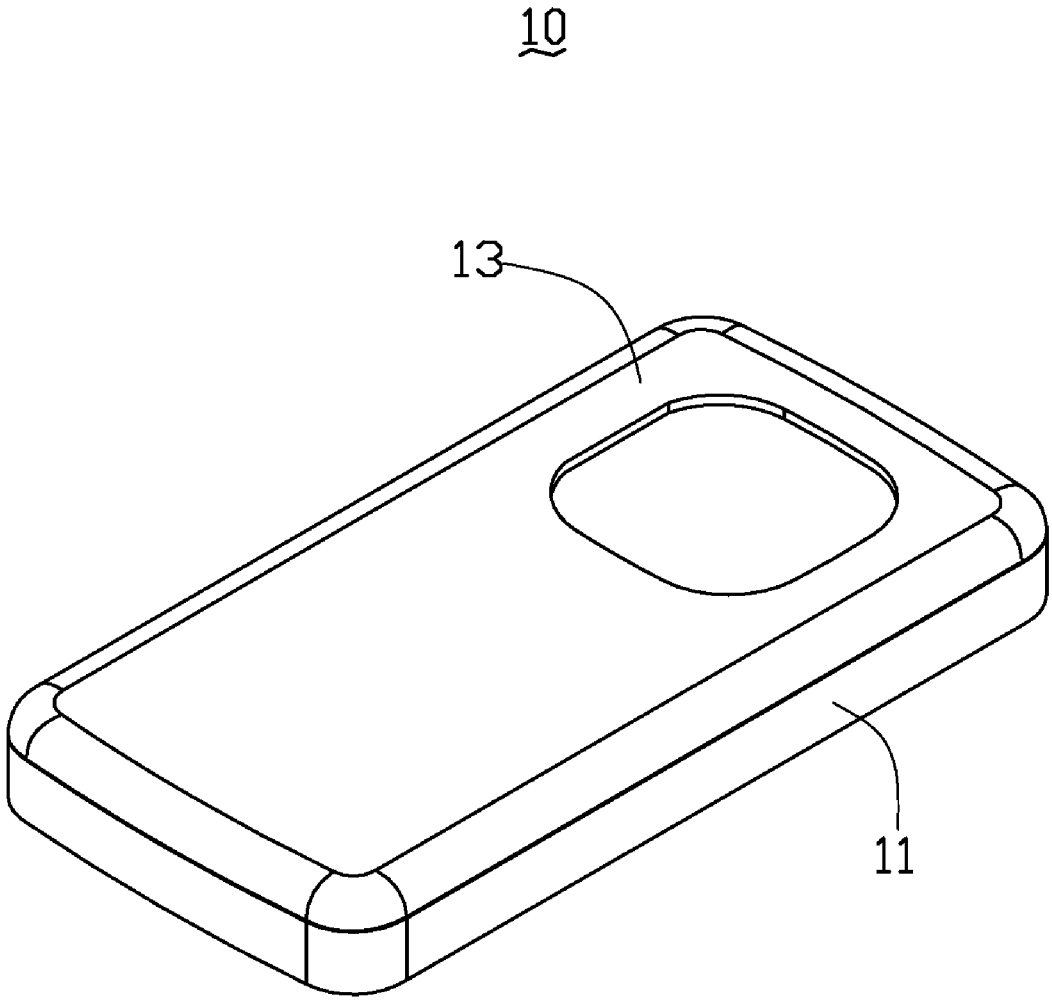
FIG. 1 is a schematic view of a wireless communication device.
Figure 2:
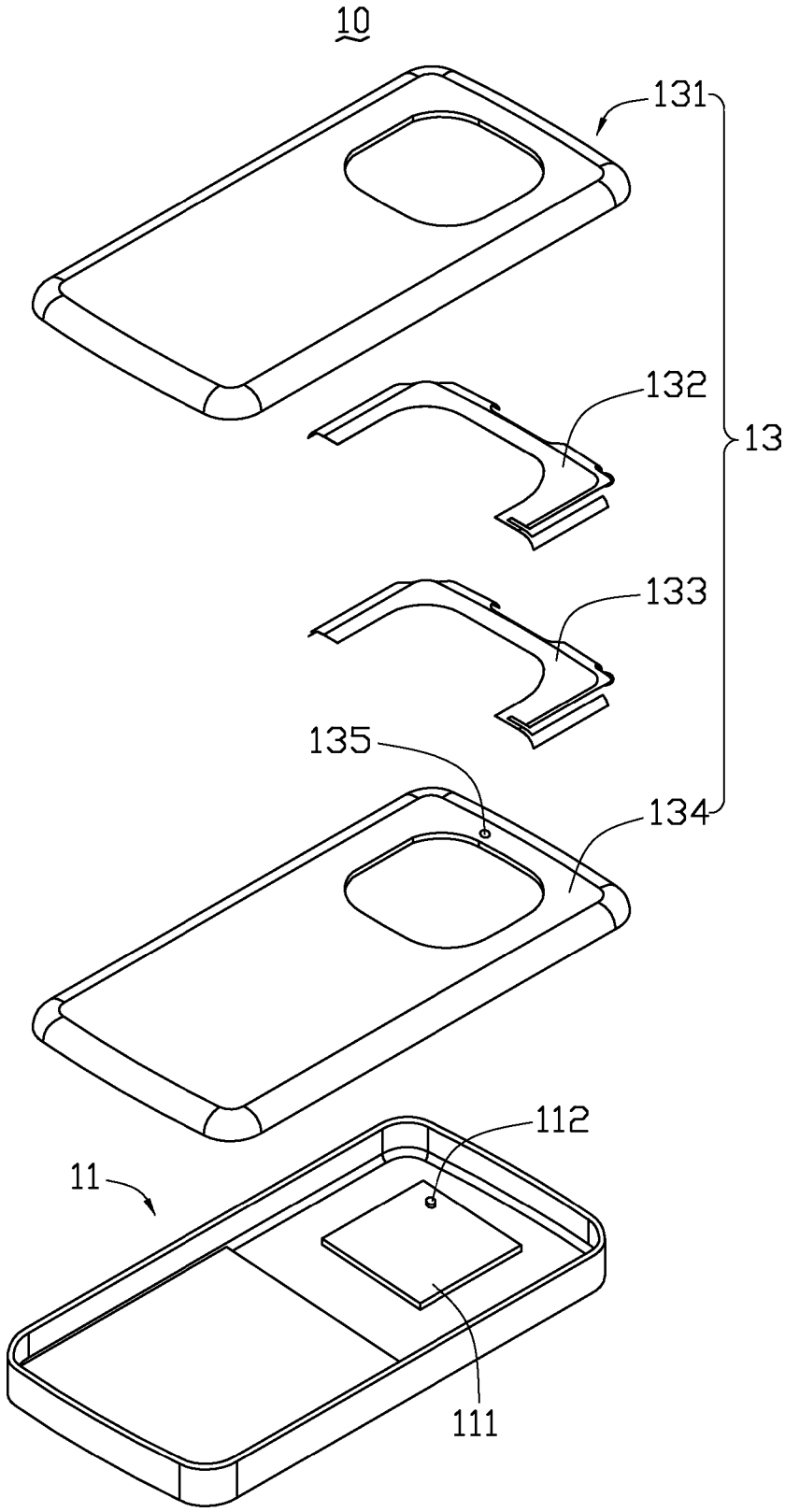
FIG. 2 is an exploded view of the wireless communication device of FIG. 1.

Referring to FIG. 1 and FIG. 2, the disclosed wireless communication device 10, here a mobile phone, includes a main body 11 and the disclosed housing 13 mounted on the main body 11.

The main body 11 includes a printed circuit board 111 installed therein. The printed circuit board 111 has a flexible conductive pole 112 configured for sending and/or receiving electromagnetic waves.

The housing 13 includes a decorative film 131, an antenna pattern 132 formed on the decorative film 131, a protective coating 133 covering the antenna pattern 132, and a substrate 134 moldingly attached to the protective coating 133 and the decorative film 131 as the antenna pattern 132 does not cover the entirety of the decorative film 131. The antenna pattern 132 and the protective coating 133 are accordingly sandwiched between the decorative film 131 and the substrate 134.

The decorative film 131 may be plastic, such as polycarbonate, acrylonitrile-butadiene-styrene, polyethylene, polyethylene terephthalate, or polypropylene. The decorative film 131 may have graphics, for example, logo of the manufacturer, formed thereon.

The antenna pattern 132 is of an electrically conductive coating made of a conductive ink. The conductive ink may have gold powder, silver powder, copper powder, carbon powder, graphite powder, or any combination thereof mixed therein. The antenna pattern 132 is manufactured via printing, in which the conductive ink is applied onto the decorative film 131. The antenna pattern 132 is 0.002 mm to 0.015 mm thick.

The protective coating 133 exhibits positive adhesion to plastic, protecting the antenna pattern 132 from abrasions and oxidization.

The substrate 134 is a molded part formed by injecting a moldable material such as plastic or silicon gel onto the decorative film 131 with the antenna pattern 132 formed thereon during an injection molding process. The substrate 134 is moldable material such as polycarbonate, acrylonitrile-butadiene-styrene, polyethylene, polyethylene terephthalate, or poly propylene, polymethyl methacrylate, silicon gel or any combination thereof. The substrate 134 may have a through hole 135 defined therein, the same size as the flexible conductive pole 112.

When the housing 13 is mounted on the main body 11, the flexible conductive pole 112 of the printed circuit board 111 enters the through hole 135 of the substrate 134 in such a manner that the conductive pole 112 contacts with or is close to the antenna pattern 132. When close to the antenna pattern 132, the gap between the conductive pole 112 and the antenna pattern 132 is less than 0.5 mm. As such, the antenna pattern 132 can communicate with the printed circuit board 111 of the main body 11.

Understandably, the flexible conductive pole 112 can be alternatively installed on the antenna pattern 132, with the gap between the conductive pole 112 and the printed circuit board 111 less than 0.5 mm.

Further, the protective coating 133 can be omitted for simplifying manufacture of the housing 13, such that antenna pattern 132 is sandwiched between the decorative film 131 and the protective coating 133.

During the disclosed manufacture of the housing 13, the decorative film 131 is provided, and partially coated with a conductive ink coating to form the antenna pattern 132 via a first printing process. Antenna pattern 132 is then coated with a protective coating 133 via a second printing process. The decorative film 131 with the antenna pattern 132 and the protective coating 133 formed thereon is placed into an injection mold. Molten moldable material is injected onto the protective coating 133 and the decorative film 131 not covered with the antenna pattern 132, so as to form the substrate 134. As such, the housing 13 with an antenna integrated thereon is obtained.

The antenna pattern 132 obtained by the disclosed process may be thinner than a currently used metal sheet antenna, thereby benefiting the reduction in profile and size of the wireless communication device 10, and further providing a simplified manufacturing process.

It should be also understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A wireless communication device, comprising:

a main body comprising a printed circuit board therein, the printed circuit board comprising a conductive pole mounted thereon, for sending and/or receiving electromagnetic waves; and a housing mounted on the main body, comprising:

a plastic decorative film having an antenna pattern directly formed thereon;

a protective coating covering the antenna pattern; and a substrate moldingly attached to the decorative film and the protective coating;

wherein the antenna pattern is a conductive ink coating, the antenna pattern and the protective coating being sandwiched between the decorative film and the substrate, a gap between the conductive pole and the antenna pattern is less than 0.5 mm.

2. The wireless communication device as claimed in claim 1, wherein the substrate is made of a moldable material selected from the group consisting of polycarbonate, acrylonitrile butadiene styrene, polyethylene, poly ethylene terephthalate, and poly propylene, poly methyl methacrylate, and silicone.

3. The wireless communication device as claimed in claim 1, wherein the conductive pole of the printed circuit board enters into a through hole of the substrate and is in contact with the antenna pattern.

4. The wireless communication device as claimed in claim 1, wherein the conductive ink coating has at least one of gold powder, silver powder, copper powder, carbon powder, and graphite powder mixed therein.

5. The wireless communication device as claimed in claim 1, wherein the antenna pattern is from 0.002 mm to 0.015 mm thick.

6. The wireless communication device as claimed in claim 1, wherein the protective coating is an ink coating from 0.002 mm to 0.015 mm thick.

* * * * *